US010344555B2

(12) United States Patent
Massey

(10) Patent No.: US 10,344,555 B2
(45) **Date of Patent: *Jul. 9, 2019**

(54) THERMALLY EXPANDED ANNULAR BARRIER, SYSTEM, AND METHOD WITH A THERMALLY DECOMPOSABLE COMPOUND

(71) Applicant: Welltec Oilfield Solutions AG, Zug (CH)

(72) Inventor: Dean Richard Massey, Copenhagen N (DK)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 350 days.

This patent is subject to a terminal disclaimer.

(21) Appl. No.: 15/022,062

(22) PCT Filed: Sep. 29, 2014

(86) PCT No.: PCT/EP2014/070738

§ 371 (c)(1),
(2) Date: Mar. 15, 2016

(87) PCT Pub. No.: WO2015/044404

PCT Pub. Date: Apr. 2, 2015

(65) Prior Publication Data

US 2016/0222753 A1 Aug. 4, 2016

(30) Foreign Application Priority Data

Sep. 30, 2013 (EP) ..... 13186654

(51) Int. Cl.

| | |
|---|---|
| ***E21B 23/06*** | (2006.01) |
| ***E21B 36/04*** | (2006.01) |
| ***E21B 33/127*** | (2006.01) |

(52) U.S. Cl.
CPC ..... *E21B 33/127* (2013.01); *E21B 23/06* (2013.01); *E21B 36/04* (2013.01)

(58) Field of Classification Search
CPC ..... E21B 33/127; E21B 23/06; E21B 36/04; F03G 7/04; F03G 7/06
(Continued)

(56) References Cited

U.S. PATENT DOCUMENTS 2,519,116 A * 8/1950 Crake ..... E21B 33/1212 166/179
2,736,261 A * 2/1956 Davis ..... F42B 3/06 102/326

(Continued)

FOREIGN PATENT DOCUMENTS

| | | |
|---|---|---|
| EP | 0 178 835 | 4/1986 |
| EP | 2 565 368 | 3/2013 |

(Continued)

OTHER PUBLICATIONS

International Search Report and Written Opinion of the ISA for PCT/EP2014/070738, dated May 11, 2015, 13 pages.

*Primary Examiner* — David J Bagnell
*Assistant Examiner* — Jonathan Malikasim
(74) *Attorney, Agent, or Firm* — Nixon & Vanderhye P.C.

(57) ABSTRACT

The present invention relates to an annular barrier (1) to be expanded in an annulus (2) between a well tubular structure (3) and an inside wall (5) of a bore-hole (6) downhole for providing zone isolation between a first zone (101) and a second zone (102) of the borehole. The annular barrier comprises a tubular metal part (7) for mounting as part of the well tubular structure; an expandable sleeve (8) surrounding the tubular metal part and having an inner face (9) facing the tubular metal part and an outer face (10) facing the inside wall of the borehole, each end (12,13) of the expandable sleeve being connected with the tubular metal part; and an (Continued)

annular space (15) between the inner face of the expandable sleeve and the tubular metal part. The annular space comprises at least one thermally decomposable compound (16), which compound is thermally decomposable below a temperature of 400° C. and is adapted to generate gas or super-critical fluid upon decomposition. Furthermore, the invention relates to a downhole system and a method of expanding an annular barrier.

22 Claims, 13 Drawing Sheets

(58) Field of Classification Search
USPC ..... 166/122, 187; 277/331, 333
See application file for complete search history.

(56) References Cited

U.S. PATENT DOCUMENTS 3,468,954 A * 9/1969 Quiquempois ..... C08J 9/107 564/2
4,846,278 A 7/1989 Robbins
7,533,731 B2 * 5/2009 Corre ..... E21B 29/10 166/187
7,673,692 B2 * 3/2010 Kunz ..... E21B 33/1277 166/122
9,359,857 B2 * 6/2016 O'Malley ..... E21B 33/124
2003/0075341 A1 4/2003 Kurlenya et al.
2009/0200290 A1 * 8/2009 Cardinal ..... E21B 43/24 219/488
2010/0252254 A1 * 10/2010 Nutley ..... C08L 23/16 166/192
2011/0094756 A1 * 4/2011 Corbett ..... E21B 33/1212 166/387
2012/0292013 A1 11/2012 Munshi et al.
2013/0056209 A1 * 3/2013 Mazyar ..... E21B 33/1208 166/302
2013/0081815 A1 4/2013 Mazyar et al.

FOREIGN PATENT DOCUMENTS

WO WO 2012/045355 4/2012
WO WO2012045355 A1 * 4/2012
WO WO 2012/136258 10/2012
WO WO2012136258 A1 * 10/2012
WO WO 2013/090257 6/2013

* cited by examiner

THERMALLY EXPANDED ANNULAR BARRIER, SYSTEM, AND METHOD WITH A THERMALLY DECOMPOSABLE COMPOUND

This application is the U.S. national phase of International Application No. PCT/EP2014/070738 filed 29 Sep. 2014, which designated the U.S. and claims priority to EP Patent Application No. 13186654.3 filed 30 Sep. 2013, the entire contents of each of which are hereby incorporated by reference.

FIELD OF THE INVENTION

The present invention relates to an annular barrier to be expanded in an annulus between a well tubular structure and an inside wall of a borehole downhole for providing zone isolation between a first zone and a second zone of the borehole. Furthermore, the invention relates to a downhole system and a method of expanding an annular barrier.

BACKGROUND ART

When completing a well, production zones are provided by submerging a casing string having annular barriers into the borehole of the well. When the casing string is in the right position in the borehole, the annular barriers are expanded or inflated. The annular barriers are in some completions expanded by pressurised fluid, which demands a certain amount of additional energy in order to pressurise the well tubular structure to a pressure sufficient to expand a metal sleeve of the annular barrier.

SUMMARY OF THE INVENTION

It is an object of the present invention to wholly or partly overcome the above disadvantages and drawbacks of the prior art. More specifically, it is an object to provide an improved annular barrier using an energy resource which is present at the well site, so that no, or not as much, additional energy is needed as in the known solutions, or so that the expansion of the annular barrier is performed with the thermal energy drawn from the downhole environment.

The above objects, together with numerous other objects, advantages and features, which will become evident from the below description, are accomplished by a solution in accordance with the present invention by an annular barrier to be expanded in an annulus between a well tubular structure and an inside wall of a borehole downhole for providing zone isolation between a first zone and a second zone of the borehole, the annular barrier comprising:

- a tubular metal part for mounting as part of the well tubular structure,
- an expandable sleeve surrounding the tubular metal part and having an inner face facing the tubular metal part and an outer face facing the inside wall of the borehole, each end of the expandable sleeve being connected with the tubular metal part, and
- an annular space between the inner face of the expandable sleeve and the tubular metal part, wherein the annular space comprises at least one thermally decomposable compound adapted to generate gas or supercritical fluid upon decomposition.

This compound may be thermally decomposable below a temperature of 400° C.

In an embodiment, the compound may comprise nitrogen.

Also, the compound may comprise nitrogen in the form of ammonium, nitrite, azide or nitrate.

Furthermore, the compound may be selected from a group consisting of: ammonium dichromate, ammonium nitrate, ammonium nitrite, barium azide, sodium nitrate, or a combination thereof.

Also, the compound may decompose at temperatures above 100° C., preferably above 180° C.

In addition, the annular space may be pre-pressurised to a pressure above 5 bar, preferably above 50 bar and more preferably above 100 bar, even more preferably above 250 bar.

Moreover, the compound may be present in the form of a powder, a powder dispersed in a liquid or a powder dissolved in a liquid.

Furthermore, the compound may be present in solid or liquid form.

Additionally, the space may be filled with the compound.

Further, the compound may be in a solid state.

Also, the compound may be insoluble.

The annular space may further comprise a fluid.

Furthermore, the compound may further comprise a catalyst.

By having a catalyst, the temperature at which the compound decomposes is decreased or increased.

Moreover, the annular barrier as described above may further comprise an opening in the tubular metal part and/or in the expandable sleeve.

Said opening may be arranged in the tubular metal part opposite the expandable sleeve for letting fluid directly into the annular space.

Additionally, sealing elements may be arranged on the outer face of the expandable sleeve.

Also, the annular barrier may comprise a chamber filled with a second compound, and the annular space may be filled with the first compound.

Additionally, the first and second compounds may be calcium carbonate and hydrochloric acid, respectively.

In addition, the chamber may be arranged in the connection part.

Furthermore, the chamber and the annular space may be divided by a shear pin.

Also, the annular space may comprise several chemicals which are already mixed into the compound and which react when heated to a certain temperature.

Additionally, the chemicals may be diesel and oxygen, e.g. in the form of air, reacting at a temperature around 210° C.

Furthermore, the chemicals may be diethyl ether and oxygen, e.g. in the form of air, reacting at a temperature around 160° C.

In addition, the annular space may comprise more than one chemical, and a spark or electrical ignition may start a reaction therebetween, creating an increased volume and an expansion of the annular barrier.

Further, the chemicals may be sodium chlorate, barium peroxide and potassium perchlorate.

Also, the annular barrier may further comprise a one-way valve.

In an embodiment, the one-way valve may be arranged in the opening.

Furthermore, the one-way valve may be arranged in the connection part.

Additionally, the one-way valve may be an overpressure valve.

The annular barrier may further comprise a heating wire arranged in or in abutment to the tubular metal part.

Moreover, the tubular metal part may comprise an electrical wire.

The electrical wire may be arranged in a groove or channel in the tubular metal part or the electrical wire may be embedded in the tubular metal part.

Also, one connection part may be slidably connected with the tubular metal part.

Furthermore, the expandable sleeve may be an expandable metal sleeve.

The present invention furthermore relates to a downhole system comprising:

a well tubular structure, and an annular barrier as described above.

In an embodiment, the well tubular structure may be filled with a fluid having a temperature above 110° C., preferably a temperature above 180° C., and more preferably a temperature above 250° C.

In addition, the fluid may be steam.

The downhole system may further comprise a tool comprising a heating unit for heating the tubular metal part of the annular barrier from within the well tubular structure.

The heating unit may be an immersion heater, a heat exchanger, a blower or the like.

Moreover, the tool may comprise isolation means for isolating a zone in the well tubular structure opposite the expandable space of the annular barrier.

Also, the heating unit of the tool may comprise a heating wire adapted to be arranged in abutment to the tubular metal part.

The tool may comprise a positioning device, such as a magnetic profiler or a casing collar locator.

Furthermore, the tool may be adapted to abut the one-way valve in the tubular metal part to provide heat to the annular space through the one-way valve.

Also, the heat may come from the fluid being hot steam, the hot steam having a temperature above 180° C.

Additionally, the tool may comprise inflatable seals.

Furthermore, the tool may comprise a pump, a motor for driving the pump, and an electronic section connected and powered through a wireline.

Moreover, the tool may be adapted to abut the one-way valve in the tubular metal part by means of a projectable arm to provide heat to the annular space through the one-way valve.

In addition, the tool may comprise a contact means adapted to electrically connect to the wire via a fluid-tight electrical contact.

The contact means may also be an induction element.

In an embodiment, the tool may further comprise a flow line which is in fluid communication with the annular space.

Also, the tool may comprise a contact means adapted to electrically connect to the wire.

The well tubular structure may be connected with a heating device at surface or seabed.

Moreover, the well tubular structure may be connected to a tubing, such as a drill pipe, for submerging the well tubular structure, the tubing being connected with a heating device at surface or seabed.

The present invention furthermore relates to a method of expanding an annular barrier as described above, comprising the steps of:

providing heat to the annular space, decomposing the thermally decomposable compound present in the annular space, generating gas or super-critical fluid, and expanding the expandable sleeve.

The heat may be increased to a temperature above 180° C. before being provided to the annular space.

The method as described above may further comprise the step of filling the expandable space with at least one thermally decomposable compound, which compound is thermally decomposable below a temperature of 400° C.

Also, the method as described above may further comprise the step of mounting the tubular metal part as part of the well tubular structure.

Moreover, the method as described above may comprise the step of pressurising the tubular metal part and the well tubular structure.

Additionally, the method as described above may comprise the step of isolating a zone opposite the opening of the annular barrier by means of a tool.

Furthermore, the method as described above may comprise the step of pressurising fluid within the zone.

In addition, the tool may comprise a pump for pressurising the fluid.

This tool may be connected by tubing to a pump arranged at surface or seabed.

The method as described above may further comprise the step of letting pressurised fluid in through an opening in the tubular metal part and into the space.

Said opening may be arranged opposite the expandable space for letting pressurised fluid directly into the annular space.

Moreover, the step of providing heat to the annular space may be performed by letting pressurised fluid in through an opening in the tubular metal part and into the space, the pressurised fluid having a temperature above 100° C.

Finally, the present invention relates to a method of manufacturing an annular barrier as described above, comprising the steps of:

providing a tubular metal part, arranging an expandable sleeve so that the sleeve surrounds the tubular metal part, whereby an annular space is created between the tubular metal part and the expandable sleeve, and providing at least one thermally decomposable compound in the annular space.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1A:
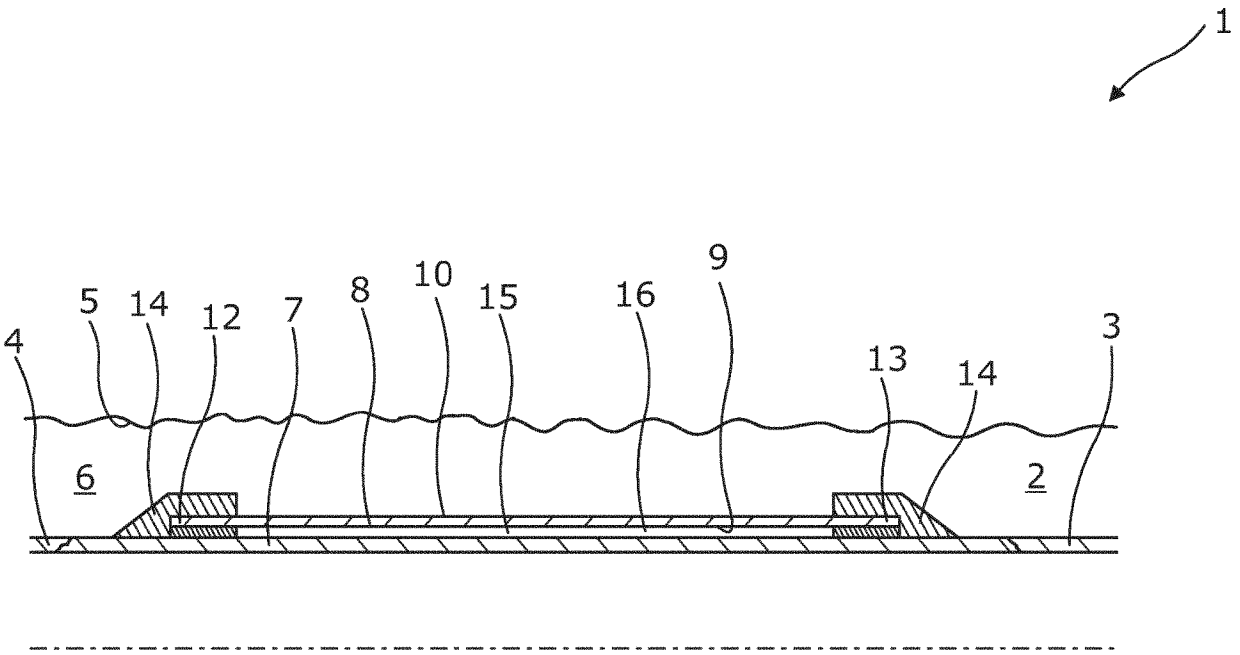
FIG. 1*a* shows a cross-sectional view of an unexpanded annular barrier.
Figure 1B:
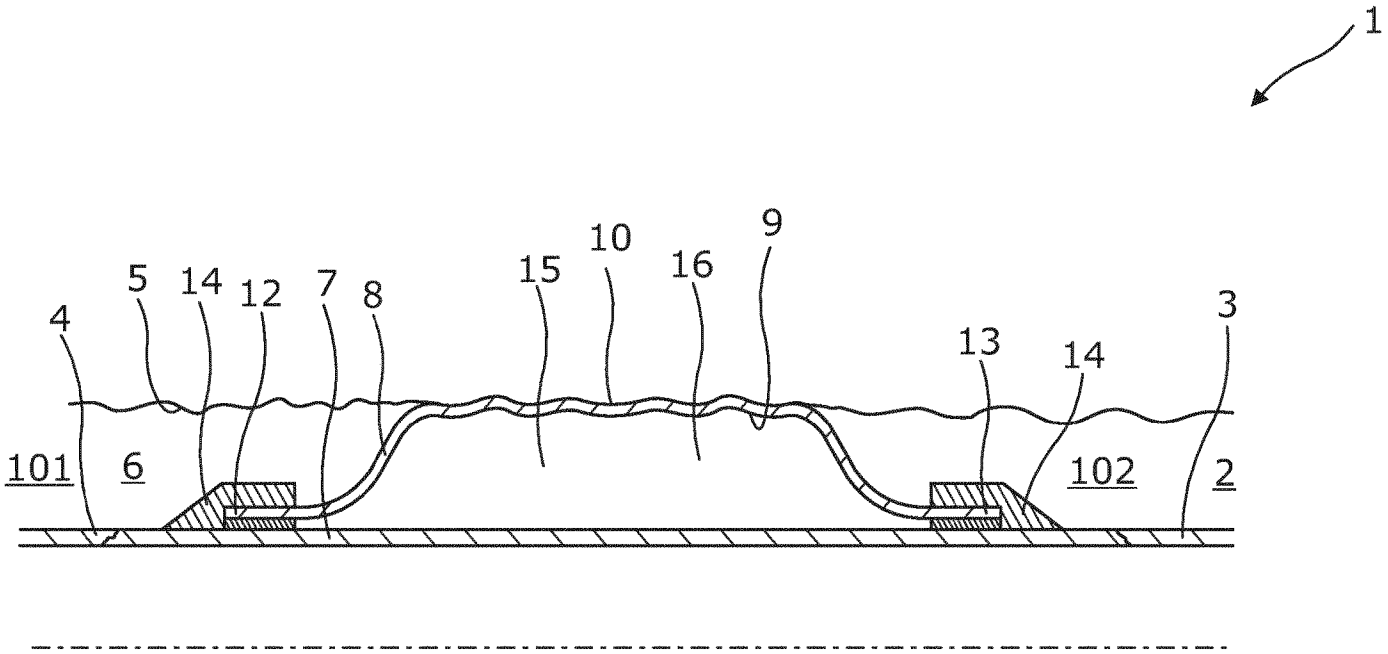
FIG. 1*b* shows a cross-sectional view of the annular barrier of FIG. 1*a* in its expanded condition.

FIG. 1*a* shows an annular barrier 1 to be expanded in an annulus 2 between a well tubular structure 3, such as a casing 4, and an inside wall 5 of a borehole 6 downhole to provide zone isolation between a first zone 101 and a second zone 102 of the borehole, as shown in FIG. 1*b*. The annular barrier 1 comprises a tubular metal part 7 for mounting as part of the well tubular structure 3 and an expandable sleeve 8 surrounding the tubular metal part. The expandable sleeve 8 has an inner face 9 facing the tubular metal part and an outer face 10 facing the inside wall 5 of the borehole 6. Each end 12, 13 of the expandable sleeve 8 is connected with a connection part 14 which is connected with the tubular metal part 7. The inner face 9 of the expandable sleeve 8 and the tubular metal part 7 define an annular space 15 therebetween, and the annular space comprises at least one thermally decomposable compound 16 adapted to generate gas or super-critical fluid upon decomposition.

The compound 16 decomposes when heated to above a certain temperature within a temperature range of 100-400° C. and is then decomposed into gas or super-critical fluid and e.g. water, and as the compound generates gas or super-critical fluid, the volume of the compound increases. In this way, the annular space increases and the expandable sleeve 8 is expanded, as shown in FIG. 1*b*, to provide zone isolation between the first zone 101 and the second zone 102 of the borehole 6. By having a decomposable compound 16 which is thermally decomposable within a temperature range of 100-400° C. in the space, the expandable sleeve 8 can be expanded without having to apply highly pressurised fluid in the casing 4 and into the space through an opening in the tubular metal part 7. In this way, the well tubular structure 3 may be designed without openings and other completion components forming part of the well tubular structure and does not need to be pressurised, which is the case in the known solution of pressurising a well tubular structure to expand an expandable sleeve.

Furthermore, the expandable sleeve 8 may be made of metal, and because the compound 16 expands the sleeve when heated, the expandable sleeve may be welded or in another way fixedly connected to the tubular metal part 7 with or without connection parts. Thus, the risk of leaks is further diminished.

Figure 2:
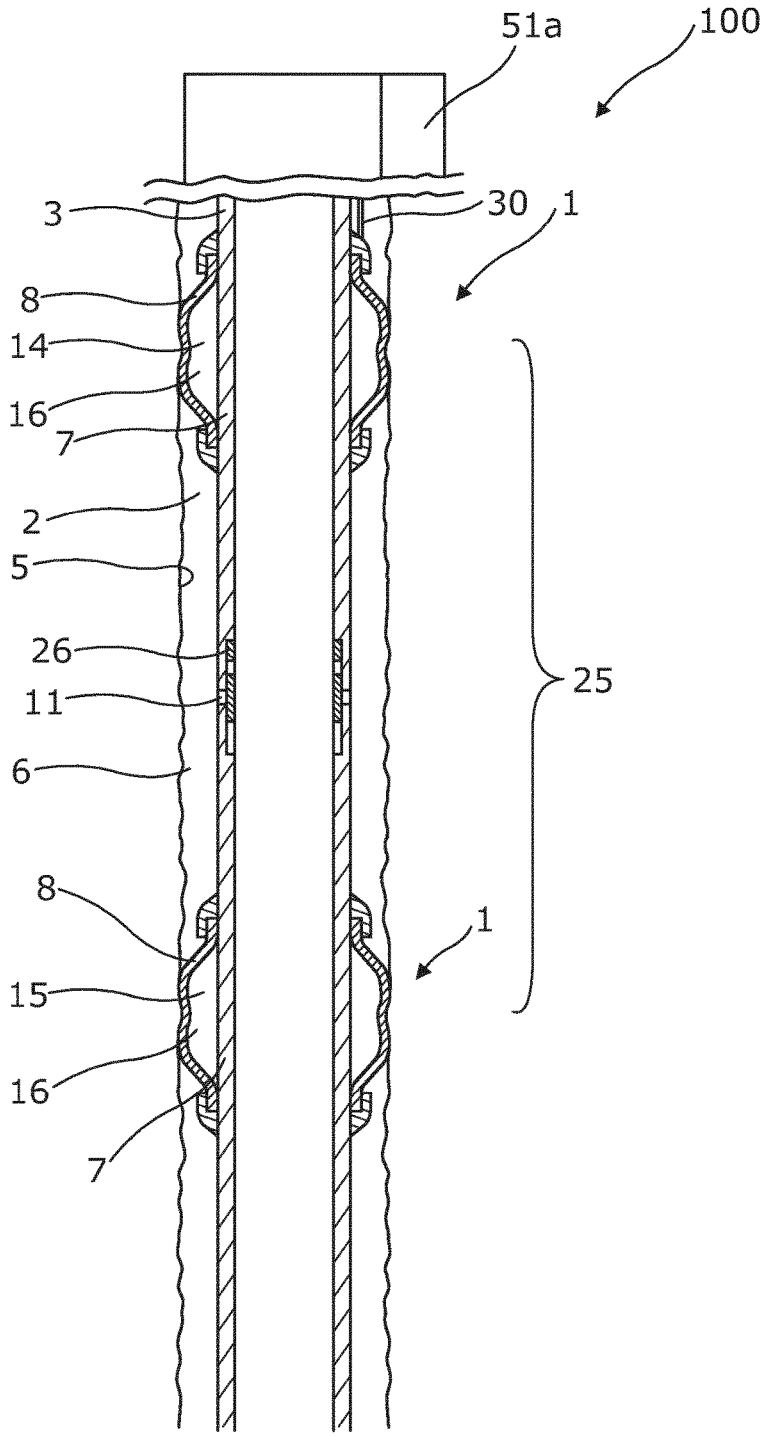
FIG. 2 shows a cross-sectional view of a downhole system having annular barriers.

FIG. 2 shows a downhole system 100 comprising two annular barriers 1, each providing an annular seal around the casing, and the annular barriers isolating a production zone 25. Hydrocarbon-containing fluid is allowed to flow into the well tubular structure through an opening 11 in the well tubular structure next to a sliding sleeve 26 when the sliding sleeve is in its open position. In another embodiment, hydrocarbon-containing fluid is allowed to flow into the well tubular structure through the opening 11 without any sliding sleeve.

The compound 16 comprised in the space 15 comprises nitrogen, such as in the form of ammonium, nitrite, azide, or nitrate, and may be selected from a group of ammonium dichromate, ammonium nitrate, ammonium nitrite, barium azide, sodium nitrate, or a combination thereof. These nitrogen-containing compounds decompose when heated at a temperature below 400° C., e.g. by flushing the casing with hot steam or a heated liquid which heats the compound 16 by heating the tubular metal part 7. At many well sites, hot steam is available as it is used for bringing up the hydrocarbon-containing fluid from the reservoir and can therefore also be used for expanding the annular barriers.

The compound 16 in the space may be present in the form of a powder, a powder dispersed in a liquid or a powder dissolved in a liquid. Thus, the compound 16 may be in a solid or liquid state, e.g. dispersed or dissolved in a liquid which may be water, mud or well fluid. As the compound 16 is heated, the compound decomposes into gas or super-critical fluid and water, and the expandable sleeve 8 is expanded. Whether it is gas or super-critical fluid depends on the pressure present downhole. The amount of compound in the space is determined by the expected pressure downhole, and if the pressure is higher than expected, the decomposition could create a super-critical fluid instead of a gas.

The compound decomposes at temperatures above 100° C. and below 400° C., preferably above 150° C. and more preferably above 180° C. The injected steam or heated fluid has a temperature around 250° C. which is sufficient to heat the compound 16 arranged in the space of the annular barrier 1 to above 200° C. Furthermore, the heat can be provided by locally heating the tubular metal part 7 and/or heating the fluid in the well tubular structure opposite the tubular metal part.

The compound may comprise a catalyst, and by having such a catalyst, the temperature at which the compound decomposes can be increased or decreased depending on the temperature conditions in the borehole. In this way, the annular barrier can be designed to a variety of well conditions.

When completing a well, the tubular metal part 7 is mounted as part of the well tubular structure and lowered into the borehole as part of the well tubular structure, e.g. by connecting the well tubular structure to a tubing, such as a drill pipe. Before inserting the annular barriers 1, the annular space may be pre-pressurised to a pressure above 5 bar, preferably above 50 bar and more preferably above 100 bar. By pre-pressurising the annular space 15, the expansion ratio provided by the decomposition of the compound 16 can be decreased, and the expansion can thus be controlled to a higher degree than when the space is not pre-pressurised.

Figure 3:
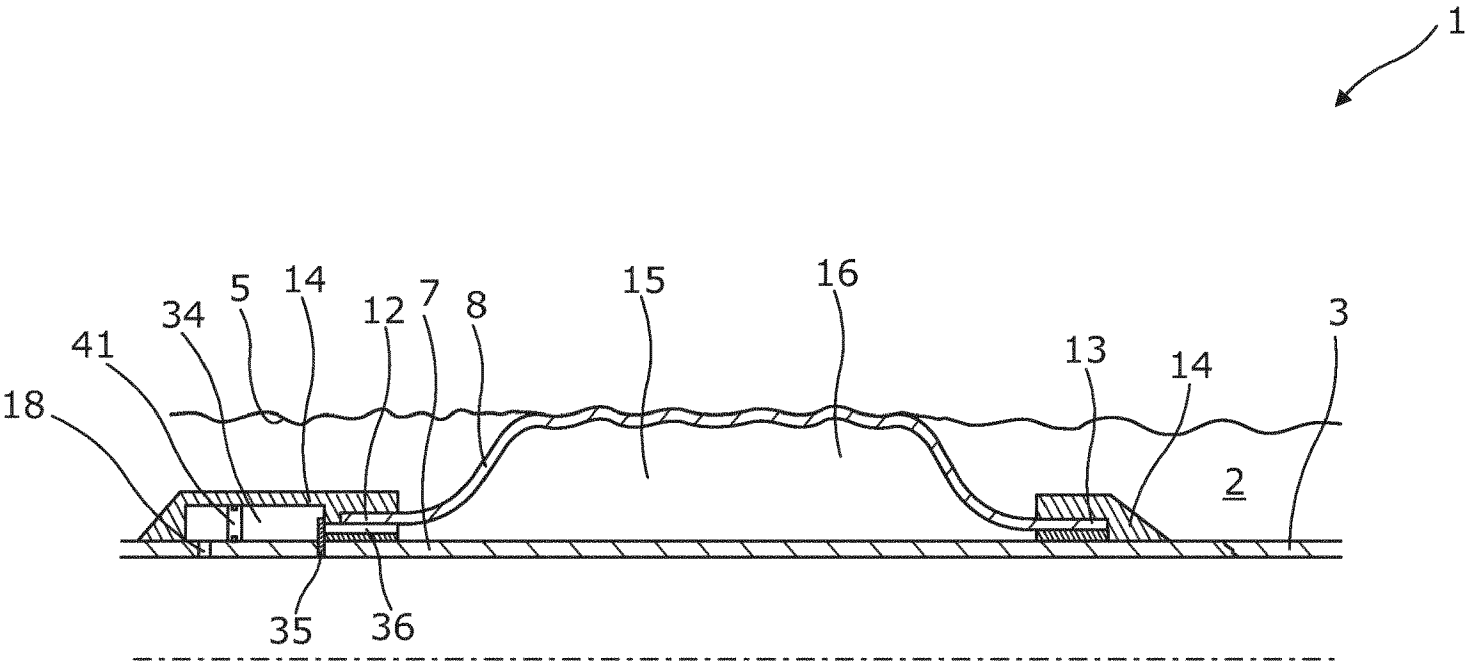
FIG. 3 shows a cross-sectional view of another annular barrier.

In FIG. 3, the annular barrier 1 comprises a chamber 34 filled with a second compound and the annular space is filled with the first compound 16. When the well tubular structure 3 is pressurised, the pressurised fluid moves a piston 41, a shear pin 35 is sheared and the first and the second compounds are mixed into the space through the fluid channel 36, and the reaction therebetween expands the sleeve.

The first and second compounds may be calcium carbonate and hydrochloric acid which, when mixed, react (and do not decompose) and generate calcium chloride, water and carbon dioxide and thereby create an increased volume resulting in an expansion of the annular barrier 1.

In another embodiment, the annular space 15 comprises several chemicals which are already mixed into the compound and which react when heated to a certain temperature and thermally decompose.

Furthermore, the first and second compounds could be chemicals mixed into the annular space 15 and could be diesel and oxygen, e.g. in the form of air, reacting and not decomposing at a temperature of 210° C., and thereby creating an expansion of the expandable sleeve. The chemicals, i.e. the first and second compounds, could also be diethyl ether and oxygen, e.g. in the form of air, reacting at a temperature of 160° C.

Also, the annular space 15 may comprise more than one chemical, and a spark or electrical ignition could start a chemical reaction (not decomposition) between the chemicals, creating an increased volume resulting in an expansion of the annular barrier 1. The chemicals could be sodium chlorate, barium peroxide and potassium perchlorate.

In addition, the annular space 15 may be filled with water, and by using electricity through wires on the outside of the well tubular structure 3, hydrogen and oxygen are generated via electrolysis.

Figure 4:
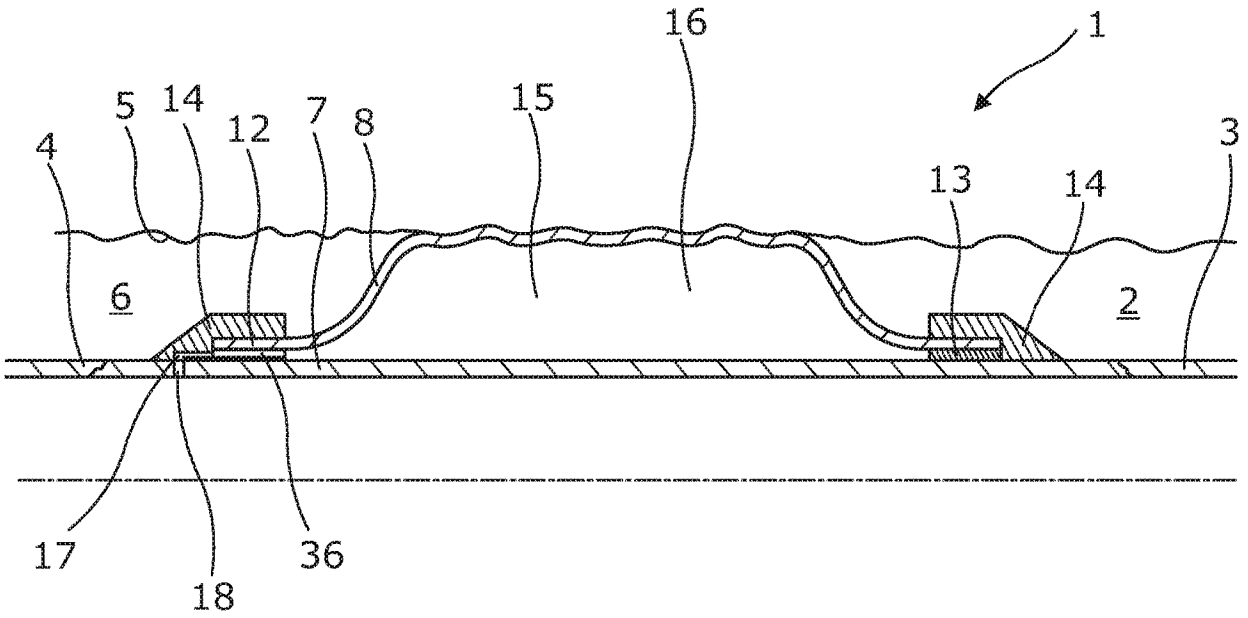
FIG. 4 shows a cross-sectional view of yet another annular barrier.

As shown in FIG. 4, the annular barrier 1 further comprises a one-way valve 17 arranged in an opening 18 in the tubular metal part 7 opposite the connection part 14 controlling the inlet of fluid through the opening 18 in through the tubular metal part 7.

Figure 5:
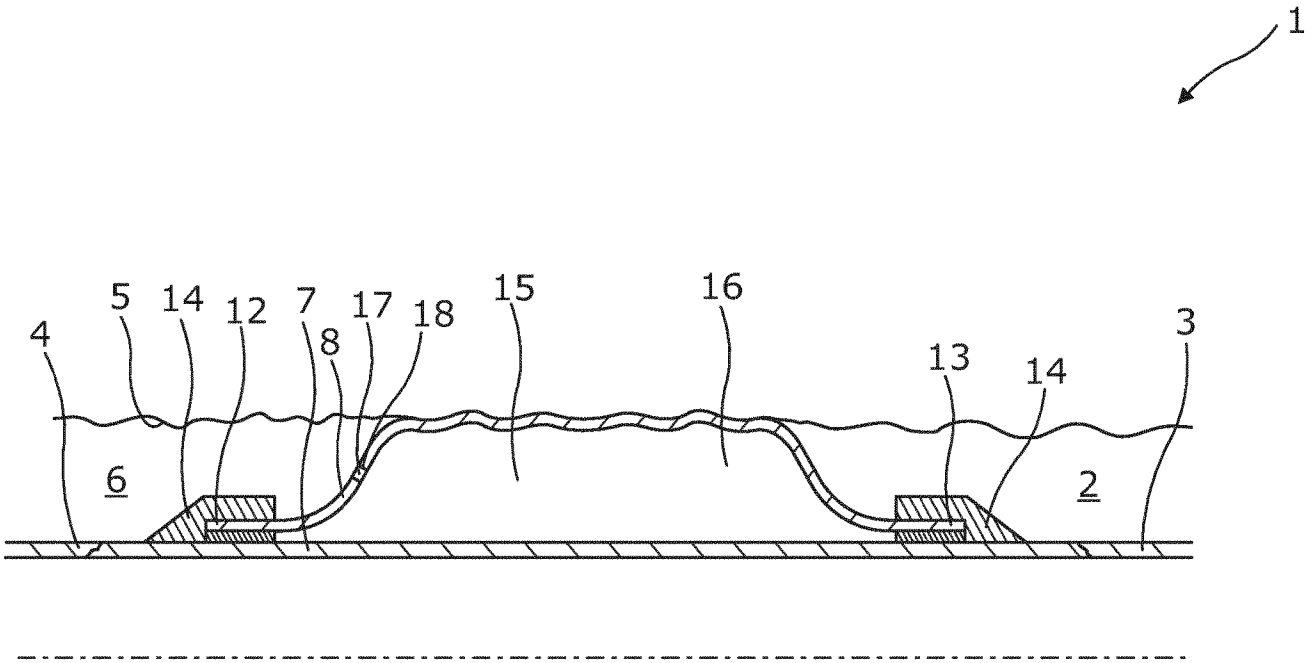
FIG. 5 shows a cross-sectional view of yet another annular barrier.

In FIG. 5, a one-way valve 17 is arranged in an opening 18 in the expandable sleeve 8. The valve 17 is an overpressure valve, meaning that when the compound 16 decomposes, the pressure inside the annular space reaches a level above a predetermined pressure, the valve opens, and the gas/super-critical fluid created by the decomposition is let out until the pressure is below the predetermined pressure. By having the overpressure valve, the expansion of the expandable sleeve 8 is controlled to ensure that the sleeve is not expanded beyond the point where most of the sleeve abuts the inside wall of the borehole 6 and not beyond the point where the sleeve ruptures. When completing a well and expanding annular barriers, the borehole diameter may vary in such a way that the inner diameter is smaller than planned. When this is the case, the compound in the space creates more expansion energy than needed, and in order to compensate for such variations, the overpressure valve lets gas/super-critical fluid out into the annulus when the pressure in the space becomes higher than required for expanding the expandable sleeve.

Figure 6A:
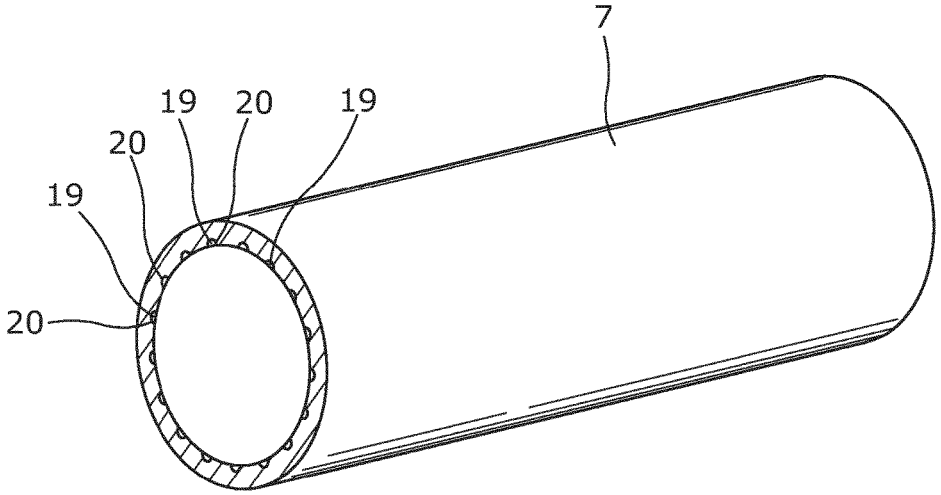
FIG. 6*a* shows a cross-sectional view of a tubular metal part of an annular barrier having heating wires.
Figure 6B:
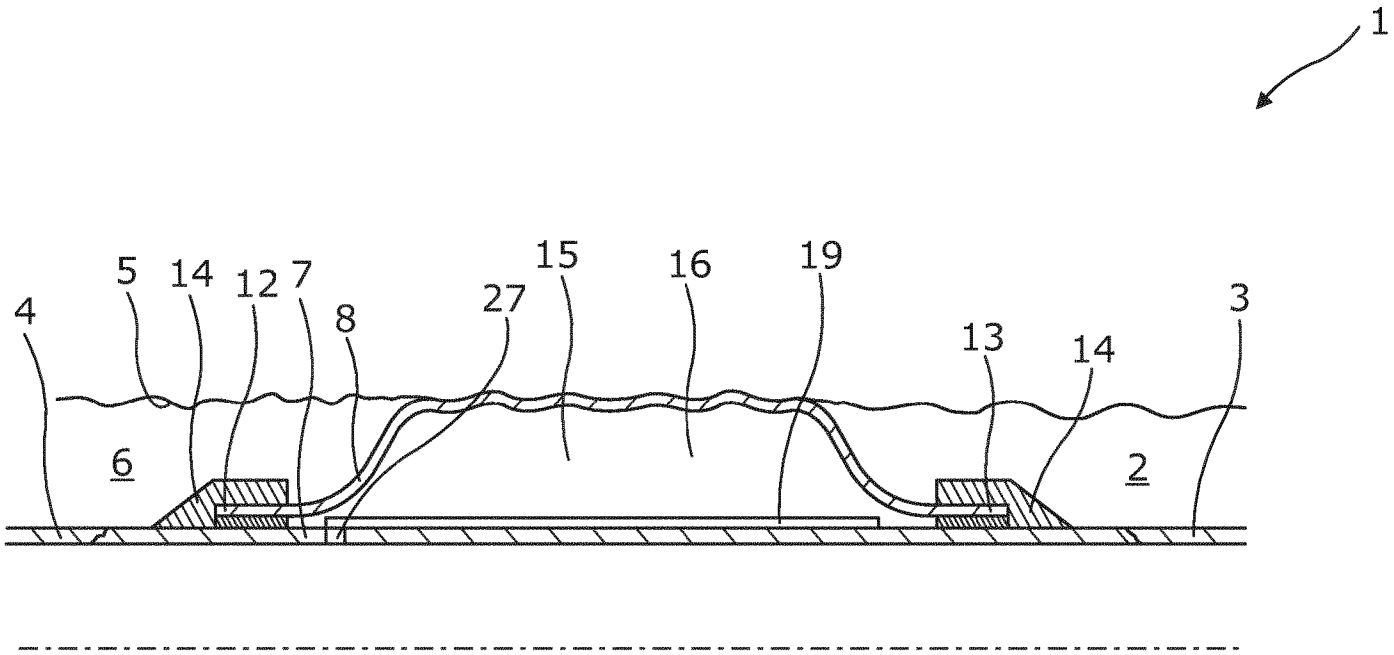
FIG. 6*b* shows a cross-sectional view of yet another annular barrier having wires in the space.

In order to heat the compound 16 in the annular space 15 of the annular barrier 1 locally, the tubular metal part 7 further comprises a heating wire 19, such as an electric wire, arranged as shown in the cross-sectional view of FIG. 6*a*, or in abutment to the tubular metal part, as shown in FIG. 6*b*. In FIG. 6*a*, the wire 19 is arranged in grooves 20, but may also be embedded in the tubular metal part. As shown in FIG. 6*b*, the wire 19 may be a mesh arranged in the space surrounding the tubular metal part 7. Electricity may be wirelessly applied to the wire 19, e.g. by means of induction or by a fluid-tight electrical contact 27 in the tubular metal part 7. Furthermore, the electrical wire may run on the outside of the well tubular structure 3 up to surface.

Figure 7A:
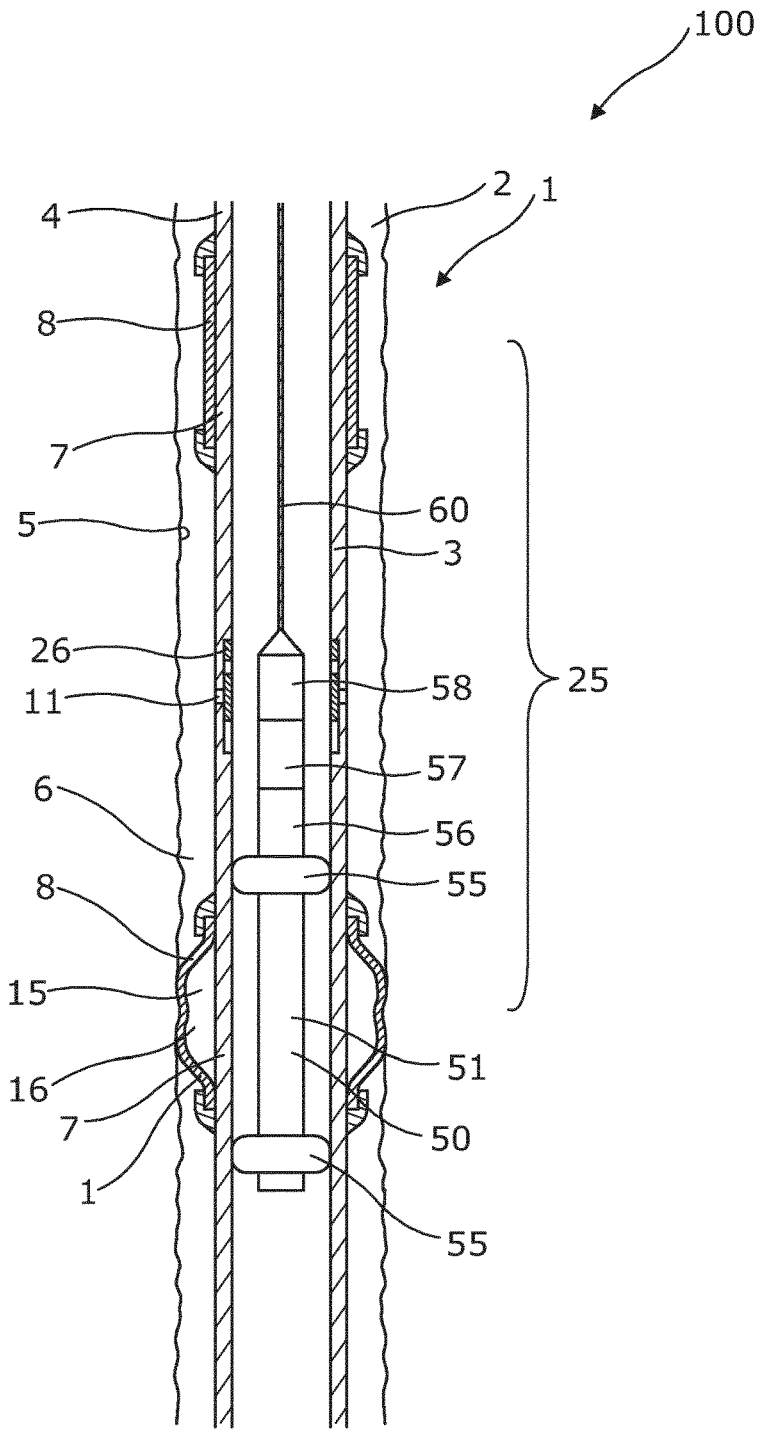
FIG. 7 shows a cross-sectional view of another downhole system having a tool for expanding the annular barriers.
Figure 7B:
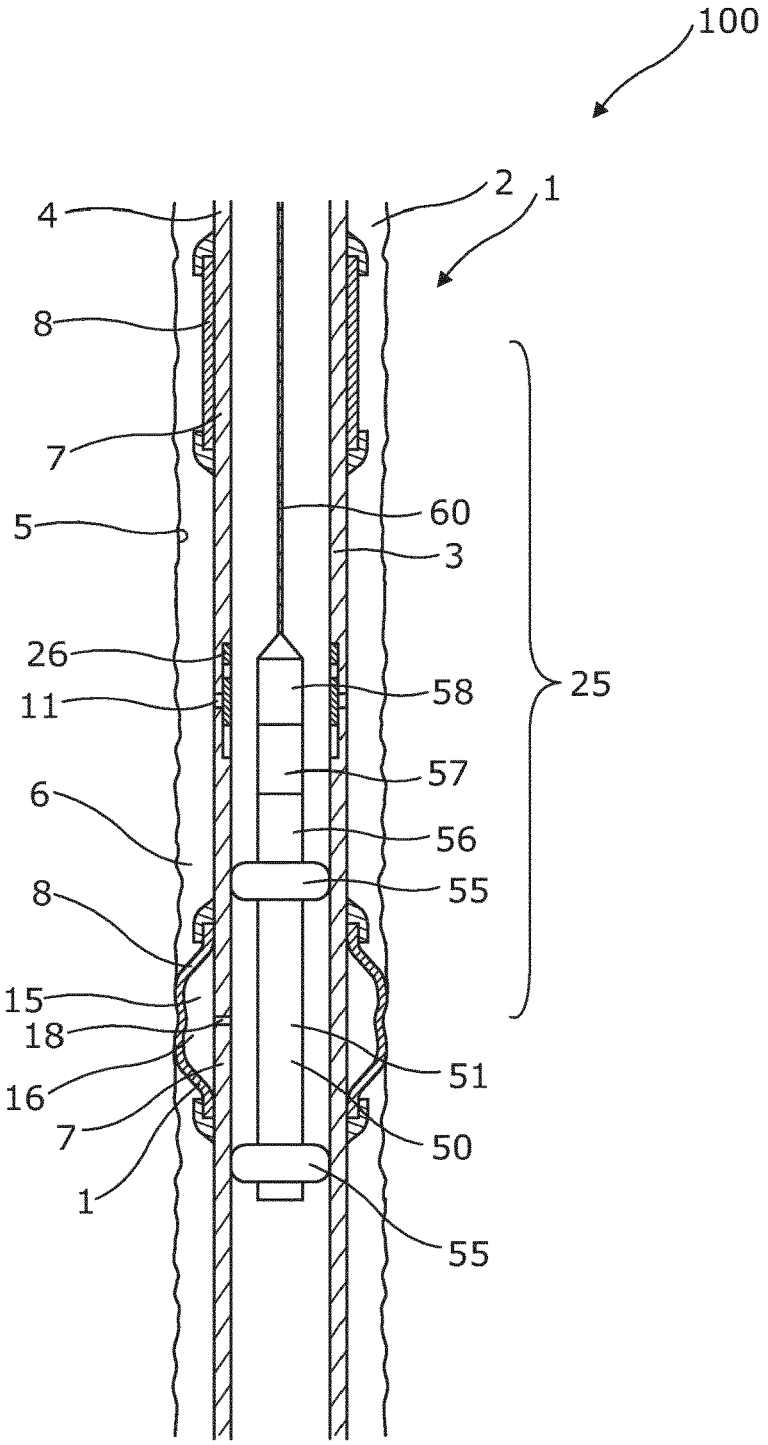

The downhole system 100 shown in FIGS. 7*a* and 7*b* comprises the well tubular structure 3 in the form of a casing 4 and two annular barriers 1. The system 100 further comprises a tool 50 comprising a heating unit 51 for heating the tubular metal part 7 of the annular barrier 1 from within the well tubular structure 3. The tool 50 comprises an isolation means, such as inflatable seals 55, a pump 56 for inflating the seals, a motor 57 for driving the pump, and an electronic section 58 connected to a wireline 60. In FIG. 7*a*, the heating unit 51 heats the well fluid surrounding the tool 50, and the heated fluid is prevented from mixing with the cooler well fluid because the seals 55 entrap the fluid to be heated. As the entrapped fluid is heated, the tubular metal part 7 and thus the compound 16 in the space are heated. When the compound 16 reaches a certain temperature, the compound decomposes and the sleeve 8 is expanded. Then, the seals of the tool 50 are deflated and the tool is moved upwards along the adjacent annular barrier 1 to expand this annular barrier as well. The tool 50 may also heat the entrapped fluid by sucking in well fluid, letting it flow past a heat exchanger in the tool and discharging the heated fluid. Thus, the heating unit 51 may be an immersion heater, a heat exchanger, a blower or similar heating element. In FIG. 7*b*, the tubular part 7 has an opening 18 for letting the heated fluid directly into the annular space 15. The heated fluid may also be pressurised by means of the pump. A one-way valve 17 may be provided in the opening for preventing the compound from leaving the space but allowing the heated fluid to enter.

Figure 8:
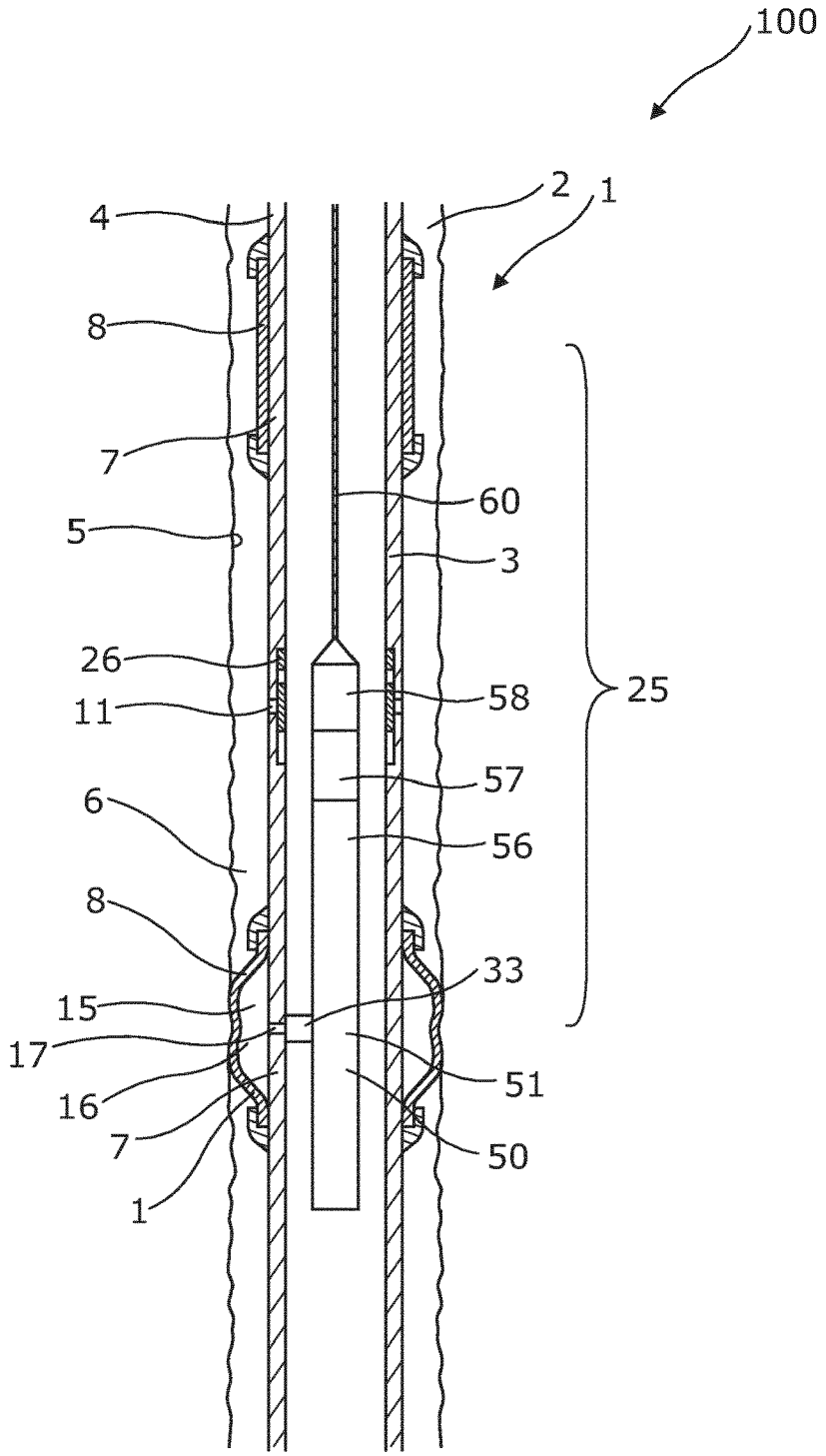
FIG. 8 shows a cross-sectional view of a downhole system having another tool for expanding the annular barriers.

In FIG. 8, the tool 50 is adapted to abut the one-way valve 17 in the tubular metal part 7 by means of a projectable arm 33 in order to provide heat to the annular space through the one-way valve. The pump 56 is used for projecting the arm 33 and for pumping fluid past the heating unit 51 and into the space.

Figure 9:
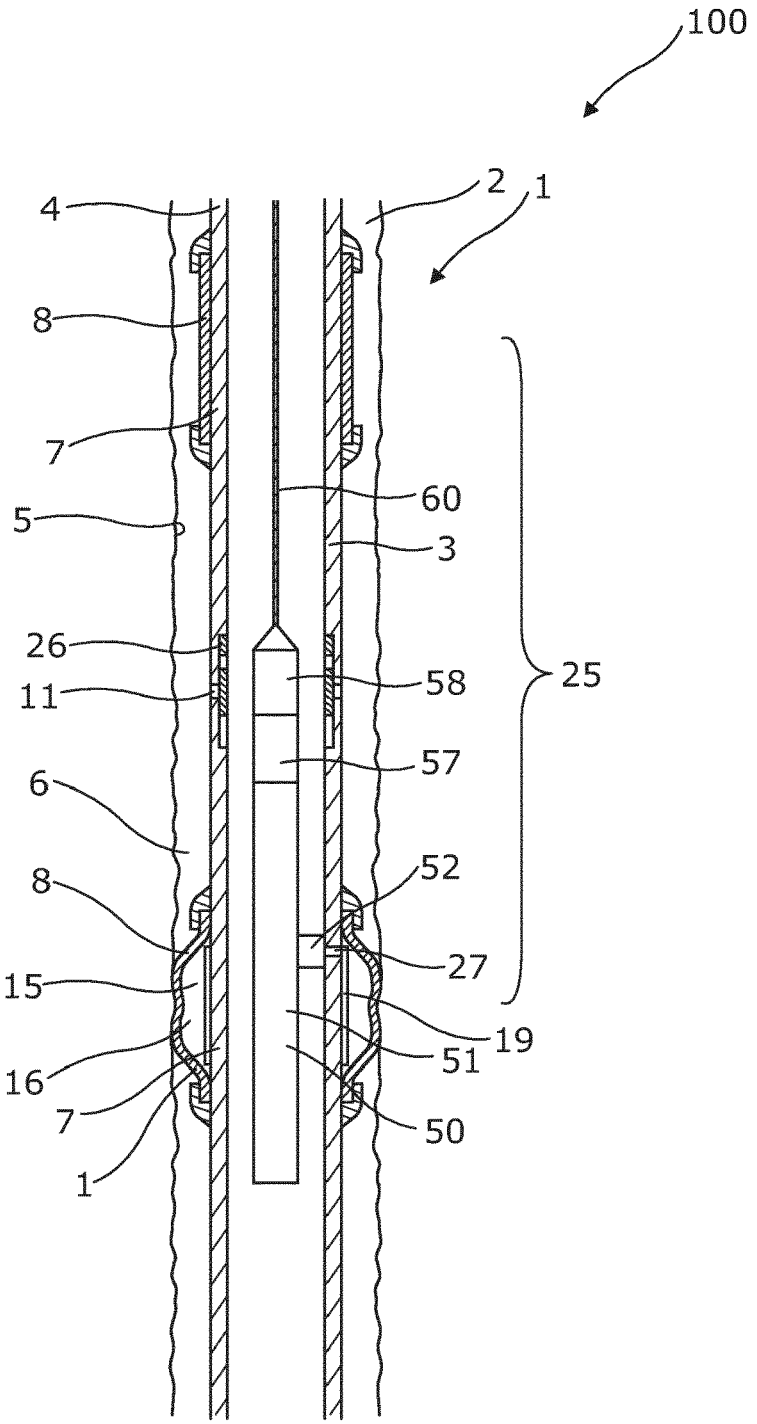
FIG. 9 shows a cross-sectional view of a downhole system having yet another tool for expanding the annular barriers.

In FIG. 9, the tool 50 comprises a contact means 52 adapted to electrically connect to the wire 19 via the fluid-tight electrical contact 27. The contact means 52 may also be an induction element. The motor 57 is used for projecting the contact means 52 to bring it in contact with the fluid-tight electrical contact 27.

The system 100 may further comprise a flow line 30 (shown in FIG. 2) being in fluid communication with the annular space, and in this way, hot steam or heated fluid may be injected into the space to expand the sleeve. The flow line is arranged outside the well tubular structure.

The annular barrier 1 is expanded by providing heat to the annular space so that the thermally decomposable compound 16 present in the annular space starts to decompose and generate gas or super-critical fluid, thereby causing the expandable sleeve 8 to expand. The compound 16 is provided in the annular space 15 before the annular barrier 1 is mounted as part of the well tubular structure.

The annular barrier 1 is mounted by providing a tubular metal part 7 and arranging an expandable sleeve 8, e.g. made of metal, in such a way that the sleeve surrounds the tubular metal part 7, whereby an annular space 15 is created between the tubular metal part and the expandable sleeve. Then, at least one thermally decomposable compound 16 is provided in the annular space 15.

The annular barrier 1 may further comprise a one-way valve 17 arranged in an opening 18 in the tubular metal part 7. In this way, the fluid, e.g. hot steam, can be injected directly into the annular space to heat the compound 16 in order to force the compound to decompose and expand the expandable sleeve 8 to abut the inside wall of the borehole 6.

Figure 10:
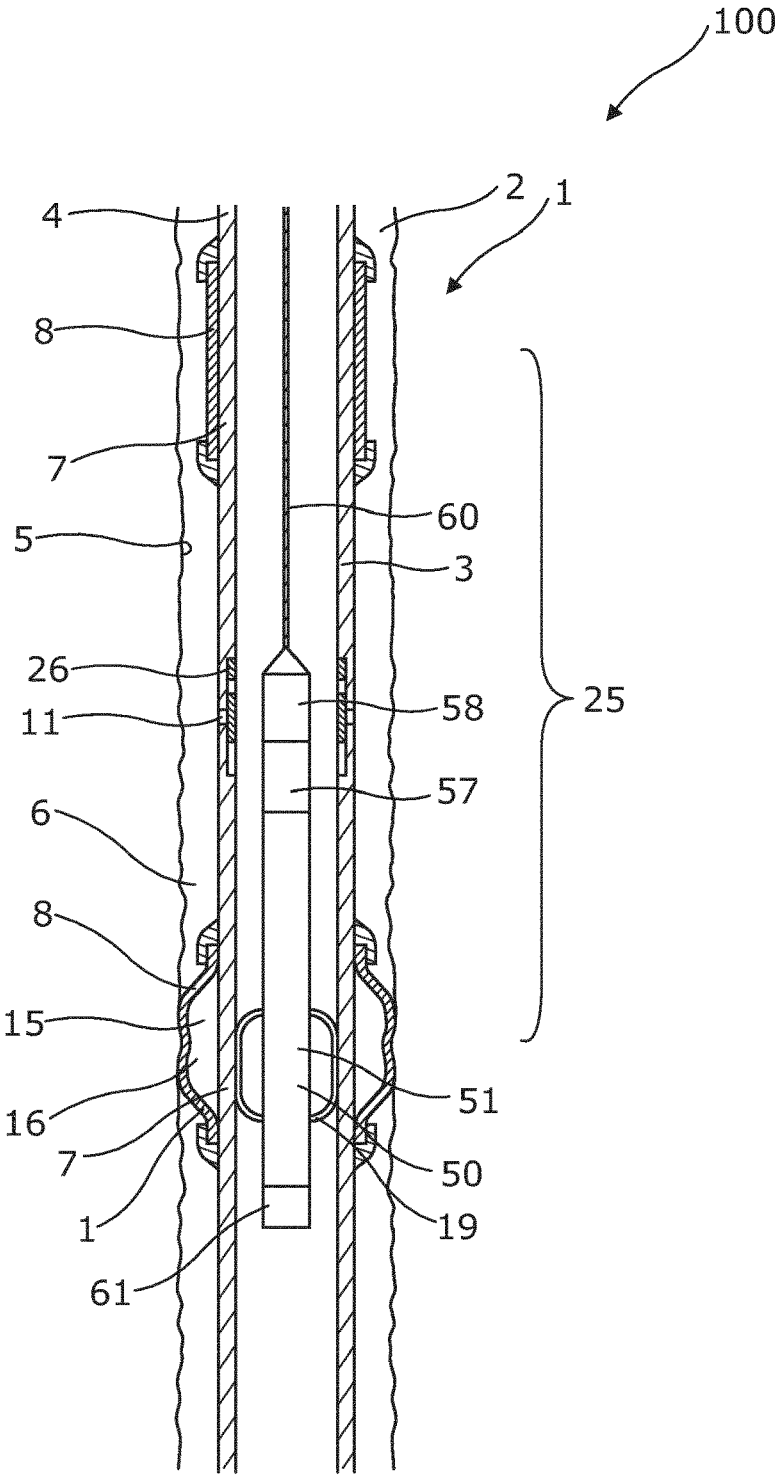

In FIG. 10, the heating unit of the tool is a heating wire 19 adapted to be arranged in abutment to the tubular metal part. Furthermore, the tool comprises a positioning device 61, such as a magnetic profiler or a casing collar locator, for location of the annular barrier to be expanded.

As shown in FIG. 2, the downhole system comprises a heating device 51*a* connected at surface or seabed with the well tubular structure or drill pipe to heat up the fluid.

By fluid or well fluid is meant any kind of fluid that may be present in oil or gas wells downhole, such as natural gas, oil, oil mud, crude oil, water, etc. By gas is meant any kind of gas compound present in a well, completion, or open hole, and by oil is meant any kind of oil compound, such as crude oil, an oil-containing fluid, etc. Gas, oil, and water fluids may thus all comprise other elements or compounds than gas, oil, and/or water, respectively.

By a casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. An annular barrier to be expanded in an annulus between a well tubular structure and an inside wall of a borehole downhole for providing zone isolation between a first zone and a second zone of the borehole, the annular barrier comprising:

a tubular metal part for mounting as part of the well tubular structure, an expandable metal sleeve surrounding the tubular metal part and having an inner face facing the tubular metal part and an outer face facing the inside wall of the borehole, each end of the expandable metal sleeve being connected with the tubular metal part, and an annular space between the inner face of the expandable metal sleeve and the tubular metal part, wherein the annular space comprises at least one thermally decomposable compound, which compound is thermally decomposable below a temperature of 400° C. and is adapted to generate gas or super-critical fluid upon decomposition to radially expand the expandable metal sleeve.

2. An annular barrier according to claim 1, wherein the compound comprises nitrogen.

3. An annular barrier according to claim 1, wherein the compound is selected from a group consisting of: ammonium dichromate, ammonium nitrate, ammonium nitrite, barium azide, sodium nitrate, or a combination thereof.

4. An annular barrier according to claim 1, wherein the compound decomposes at temperatures above 100° C.

5. An annular barrier according to claim 1, wherein the compound is present in the form of a powder, a powder dispersed in a liquid or a powder dissolved in a liquid.

6. An annular barrier according to claim 1, further comprising an opening in the tubular metal part and/or in the expandable metal sleeve.

7. An annular barrier according to claim 6, wherein a one-way valve is arranged in the opening.

8. An annular barrier according to claim 1, further comprising a heating wire arranged in or in abutment to the tubular metal part.

9. An annular barrier according to claim 1, wherein the compound decomposes at temperatures above 180° C.

10. A downhole system comprising:

the well tubular structure, and the annular barrier according to claim 1.

11. A downhole system according to claim 10, wherein the well tubular structure is filled with a fluid having a temperature above 110° C.

12. A downhole system according to claim 10, further comprising a tool comprising a heating unit for heating the tubular metal part of the annular barrier from within the well tubular structure.

13. A downhole system according to claim 12, wherein the tool is configured to isolate a zone in the well tubular structure opposite the expandable space of the annular barrier.

14. A downhole system according to claim 12, wherein the heating unit of the tool comprises a heating wire adapted to be arranged in abutment to the tubular metal part.

15. A downhole system according to claim 10, wherein the well tubular structure is connected with a heating device configured to be located at surface or seabed.

16. A downhole system according to claim 10, wherein the well tubular structure is connected to a tubing for submerging the well tubular structure, the tubing being connected with a heating device at surface or seabed.

17. A downhole system according to claim 10, wherein the well tubular structure is filled with a fluid having a temperature above 250° C.

18. A method of expanding an annular barrier according to claim 1, comprising:

providing heat to the annular space, decomposing the thermally decomposable compound present in the annular space, generating gas or super-critical fluid, and expanding the expandable metal sleeve.

19. A method according to claim 18, further comprising:

filling the expandable space with at least one thermally decomposable compound, which compound is thermally decomposable below a temperature of 400° C.

20. A method according to claim 18, further comprising:

pressurising the tubular metal part and the well tubular structure.

21. A method according to claim 18, further comprising:

isolating a zone opposite the opening of the annular barrier by means of a tool.

22. A method according to claim 18, wherein said providing heat to the annular space is performed by letting pressurised fluid in through an opening in the tubular metal part and into the space, the pressurised fluid having a temperature above 100° C.

* * * * *